US012383003B2

(12) United States Patent
Valentine

(10) Patent No.: US 12,383,003 B2
(45) Date of Patent: Aug. 12, 2025

(54) MEDICAL GOWN WITH TEAR GUIDE FEATURE

(71) Applicant: DEPRE, LLC, Powell, TN (US)

(72) Inventor: Ethan Edward Valentine, Knoxville, TN (US)

(73) Assignee: DEPRE, Powell, TN (US)

( * ) Notice: Subject to any disclaimer, the term of this patent is extended or adjusted under 35 U.S.C. 154(b) by 0 days.

(21) Appl. No.: 18/563,761

(22) PCT Filed: May 13, 2022

(86) PCT No.: PCT/US2022/029263

§ 371 (c)(1),
(2) Date: Nov. 22, 2023

(87) PCT Pub. No.: WO2022/250985

PCT Pub. Date: Dec. 1, 2022

(65) Prior Publication Data

US 2024/0285004 A1 Aug. 29, 2024

Related U.S. Application Data

(60) Provisional application No. 63/194,078, filed on May 27, 2021.

(51) Int. Cl.
*A41D 13/12* (2006.01)
*A41D 27/24* (2006.01)

(52) U.S. Cl.
CPC ..... *A41D 13/1209* (2013.01); *A41D 13/129* (2013.01); *A41D 27/245* (2013.01)

(58) Field of Classification Search
CPC ..... A41D 13/12; A41D 13/1209; A41D 13/1236; A41D 13/1245; A41D 13/1263;
(Continued)

(56) References Cited

U.S. PATENT DOCUMENTS 5,799,330 A * 9/1998 O'Donoghue-Kitt ..... A41D 13/129 2/908

2013/0276204 A1 10/2013 Pasko et al.

(Continued)

FOREIGN PATENT DOCUMENTS

| | | | |
|---|---|---|---|
| KR | 10-2223940 | B1 | 3/2021 |
| WO | 9526649 | A1 | 10/1995 |
| WO | 2022/250985 | A1 | 12/2022 |

OTHER PUBLICATIONS

Korean Intellectual Property Office, Written Opinion of the International Searching Authority issued on corresponding PCT Application No. PCT/US2022/029263 dated Sep. 8, 2022, 6 pages.

(Continued)

*Primary Examiner* — Sally Haden

(74) *Attorney, Agent, or Firm* — Baker, Donelson, Bearman, Caldwell & Berkowitz, P.C.; Edward D. Lanquist, Jr.; Dominic A. Rota

(57) ABSTRACT

A medical gown (100) configured for controlled doffing away from a user is disclosed herein. The medical gown may include a neck opening (150) and a tear guide (160) extending downwardly from the neck opening along a rear side (104) of the medical gown. The tear guide may extend between the neck opening and a nearest lower edge (144) of the rear side of the medical gown. The nearest lower edge may comprise an upper end of a flap opening of the rear side of the medical gown. The flap opening (140) may be defined between first and second flaps of the rear side of the medical gown. The tear guide may comprise a heat weld defined in the rear side of the medical gown.

15 Claims, 9 Drawing Sheets

(58) Field of Classification Search
CPC ..... A41D 13/129; A41D 2300/52; A41D 2400/44
See application file for complete search history.

(56) References Cited

U.S. PATENT DOCUMENTS

| | | | | |
|---|---|---|---|---|
| 2014/0007316 | A1 | 1/2014 | Tommarello et al. | |
| 2018/0343940 | A1 | 12/2018 | Genender et al. | |
| 2024/0251890 | A1* | 8/2024 | Andrews | A41H 42/00 |

OTHER PUBLICATIONS

Korean Intellectual Property Office, International Search Report issued on corresponding PCT Application No. PCT/US2022/029263 dated Sep. 8, 2022, 3 pages.

* cited by examiner

MEDICAL GOWN WITH TEAR GUIDE FEATURE

CROSS-REFERENCE TO RELATED APPLICATIONS

This application is a § 371 national stage entry of PCT/US2022/029263 filed May 13, 2022, which claims priority to U.S. Provisional Patent Application No. 63/194,078 entitled "MEDICAL GOWN WITH TEAR GUIDE FEATURE," filed May 27, 2021, both which are hereby incorporated by reference in their entireties.

TECHNICAL FIELD

The present invention relates generally to gowns. More particularly, this invention pertains to medical gowns.

BACKGROUND ART

Medical gowns are commonly used in hospitals, clinics and other diagnostic facilities. Medical gowns are worn by both users and health care providers during medical procedures. Medical gowns serve a protective function by helping to prevent the transmission of germs and microbes.

One issue with prior art medical gowns is that they are time consuming to put on (i.e., donning) and take off (i.e., doffing). Additionally, where the gown is sterile, it is difficult to don a gown without compromising the gown's exterior sterility. Removing a medical gown can also be difficult and may compromise the protective function thereof by transmitting germs to the user while removing the gown. It would be advantageous to have an improved medical gown. Certain prior art medial gowns have a vertical perforation along a rear side to assist with doffing the gown. The issue with these vertical perforations is that their openings may compromise the protective function of the gown by allowing germ and/or fluid transmission therethrough.

DISCLOSURE OF THE INVENTION

The present disclosure provides a disposable medical gown that can easily be donned and doffed. The disposable medical gown features at least an upper section that is continuous along a rear side. A lower section of the rear side may feature abutting or overlapping fabric to define a slit in the back (e.g., defined between left and right flaps) that terminate into the continuous upper section. The disposable medical gown further includes a tear guide feature or weakened path defined along the upper section and extending downward from a neck hole of the upper section towards the slit of the lower section and optionally downward along the lower section when no slit is present. The tear guide feature may be created using ultrasonic sewing. Alternatively, the tear guide feature may be created using heat welding, traditional ultrasonic welding, radio-frequency (RF) welding, or the like. Ultrasonic welding is used in place of and is an improvement upon traditional perforations because the protective function of the gown is not compromised by the welding process while it is compromised by traditional perforations. The strip of material weakened by the welding process may more easily tear or rip as well as direct or guide the path of the tear when doffing the gown to further ensure the protective nature of the gown even during disrobing thereof.

In a particular embodiment, an exemplary medical gown comprises a neck opening and a tear guide extending downwardly from the neck opening along a rear side of the medical gown. The tear guide may extend between the neck opening and a nearest lower edge of the rear side of the medical gown. The nearest lower edge may comprise an upper end of a flap opening of the rear side of the gown. The flap opening may be defined between first and second flaps of the rear side of the medical gown. The tear guide may comprise a heat weld defined in the rear side of the medical gown. The tear guide may include a V-shaped portion extending downward from the neck opening and a straight portion extending downward form the V-shaped portion. The V-shaped portion may be coupled to the neck opening at first and second locations separated by 2 inches. The V-shaped portion may include a length of at least 4 inches extending downward from the neck opening.

In another embodiment, a method of doffing the medical gown configured to surround at least a portion of a user is disclosed herein. The method may include applying a perpendicular force in a forward direction to a front portion of the medical gown away from the user and ripping a rear portion of the medical gown along a weakened strip of material defined along a rear surface of the medical gown extending downward from a neck opening of the medical gown. The weakened strip of material may be created by heat welding a portion of a material of the medical gown. The ripped rear portion of the medical gown may occur along or proximate to the weakened strip of material. The method may further comprise removing the medical gown in the forward direction away from the user by separating the ripped rear portion around the user.

In another embodiment, a method of creating a medical gown configured for controlled doffing away from a user is disclosed herein. The method may comprise defining a weakened portion along a rear surface of the medical gown. The weakened portion may extend downward from a neck opening of the medical gown. The weakened portion may extend from the neck opening to a nearest lower edge defined along a portion of the rear surface of the medical gown. The nearest lower edge of the medical gown comprises an upper end of a flap opening of the rear side of the medical gown. The weakened portion may include a V-shaped portion extending downward from the neck opening and a straight portion extending downward form the V-shaped portion.

BEST MODE FOR CARRYING OUT THE INVENTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

Figure 1:
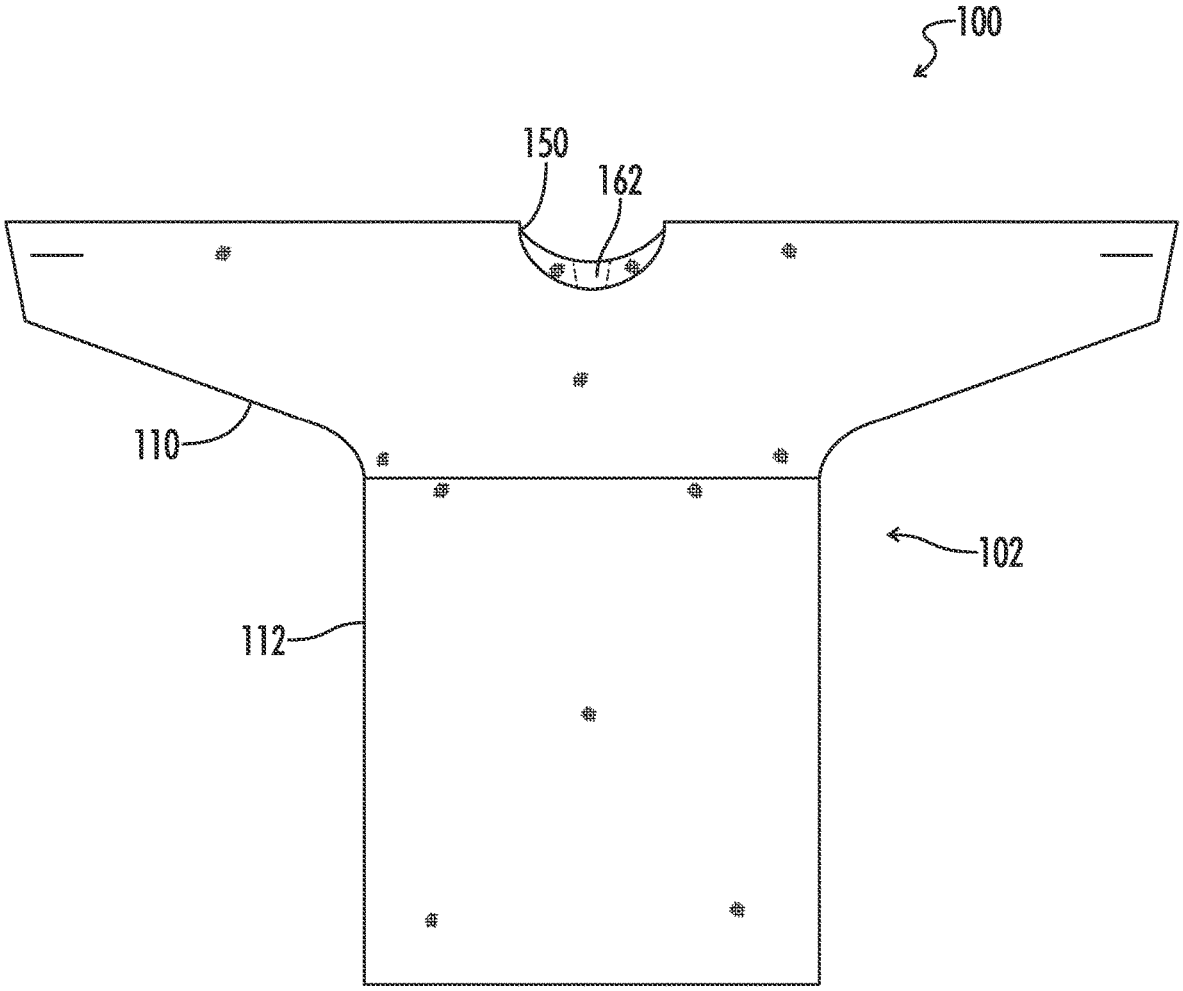
FIG. 1 is a front elevation view of a medical gown in accordance with the present disclosure.
Figure 2:
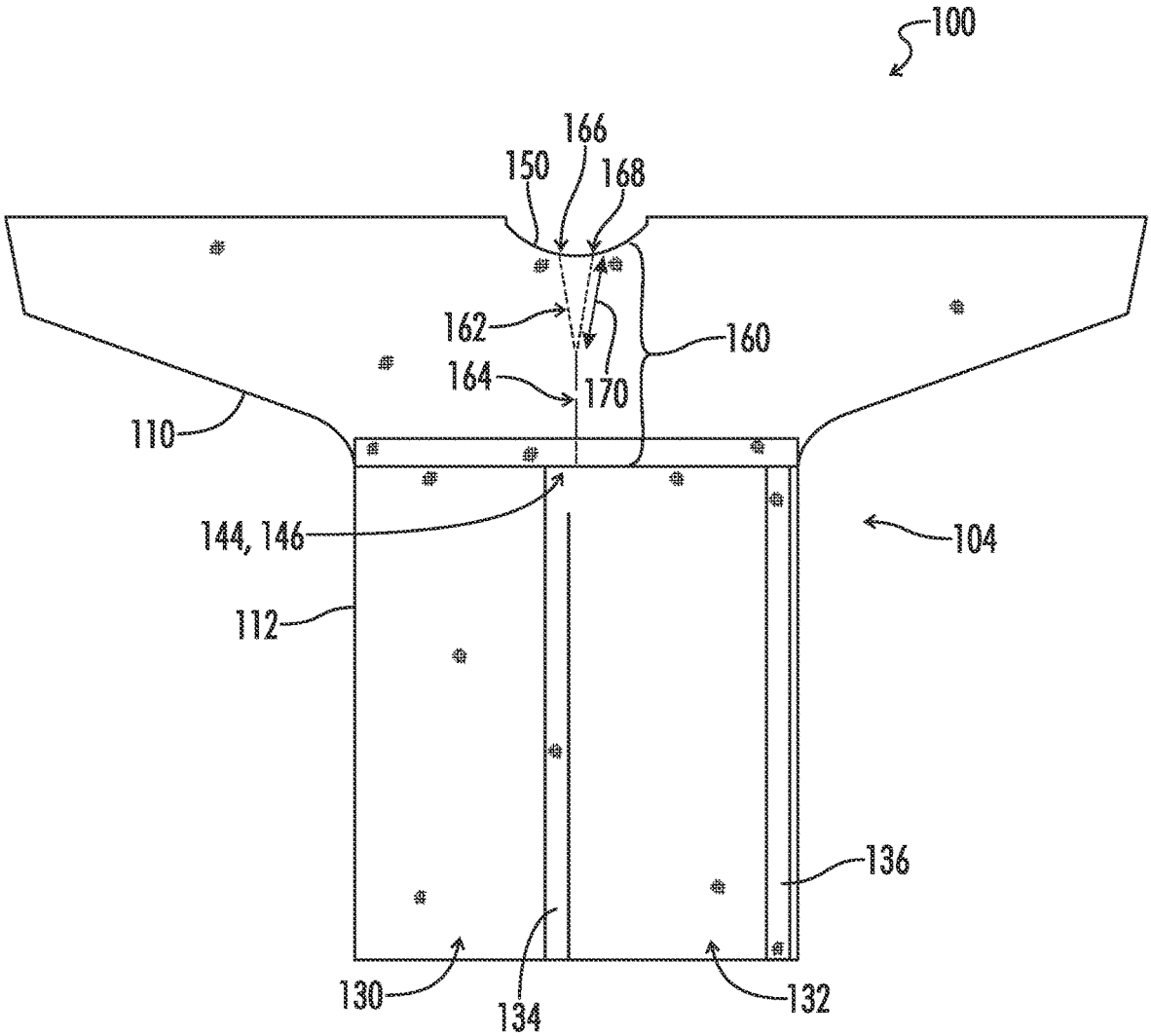
FIG. 2 is a rear elevational view of the medical gown of FIG. 1 in accordance with the present disclosure.
Figure 3:
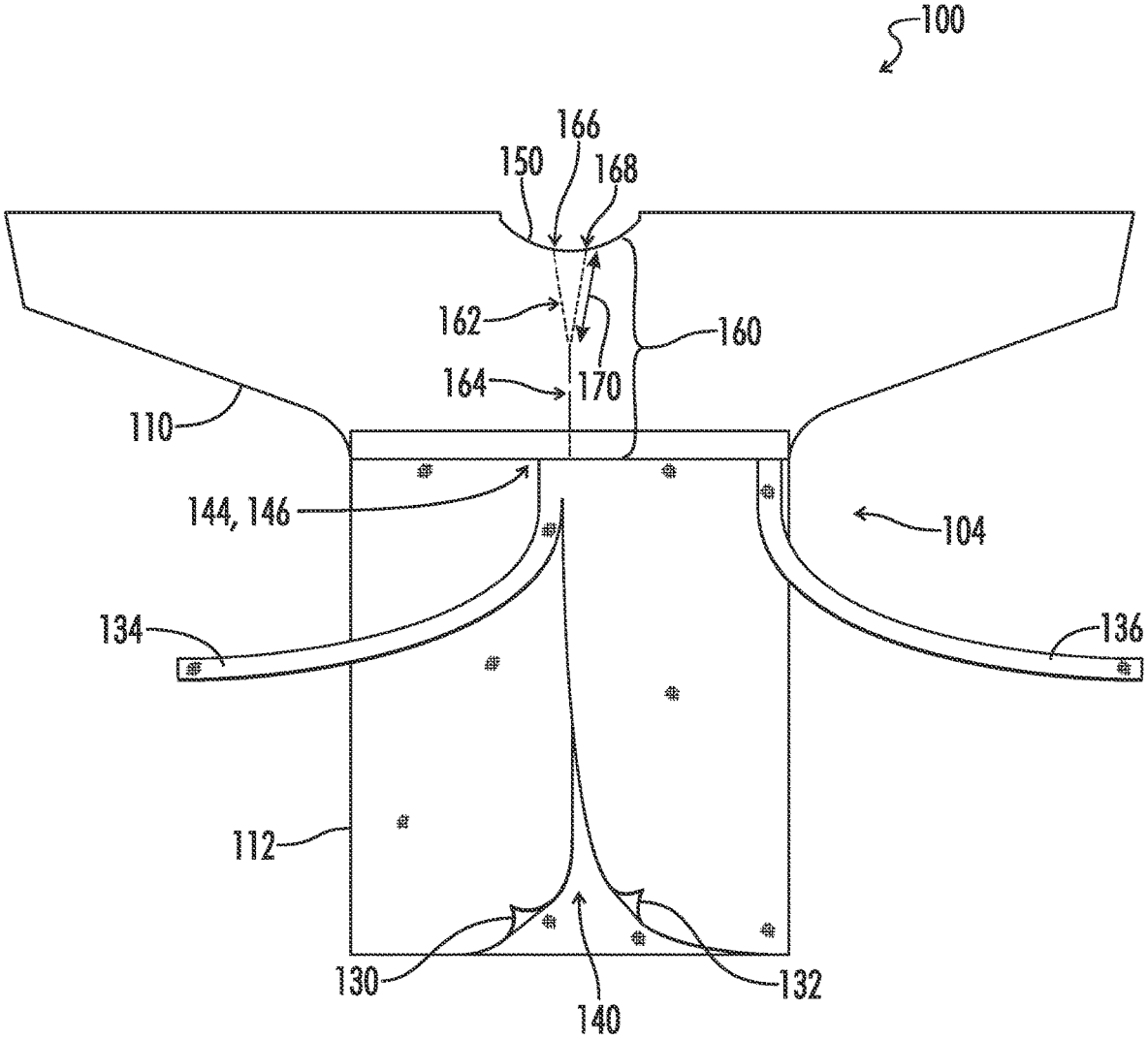
FIG. 3 is a rear elevational view of the medical gown of FIG. 1 with left and right flaps in a lifted state in accordance with the present disclosure.

Referring to FIGS. 1-3, a medical gown 100 is shown. The medical gown 100 may also be referred to herein as a disposable medical gown 100, an isolation gown 100, or a gown 100. The medical gown 100 is configured such that it can be easily donned and doffed. A front side 102 of the medical gown 100 is shown in FIG. 1 and a rear side 104 of the medical gown 100 is shown in FIGS. 2-3.

The medical gown 100 may include a top portion 110 and a bottom portion 112. The top portion 110 and the bottom portion 112 may be separate pieces coupled together. In other optional embodiments, the top portion 110 and the bottom portion 112 may be integrally formed, as shown by the material cut pattern 200 in FIG. 8, as well as shown in FIGS. 4-7. The top portion 110 may also be referred to herein as a top piece 110. The bottom portion 112 may also be referred to herein as a bottom piece 112.

Figure 4:
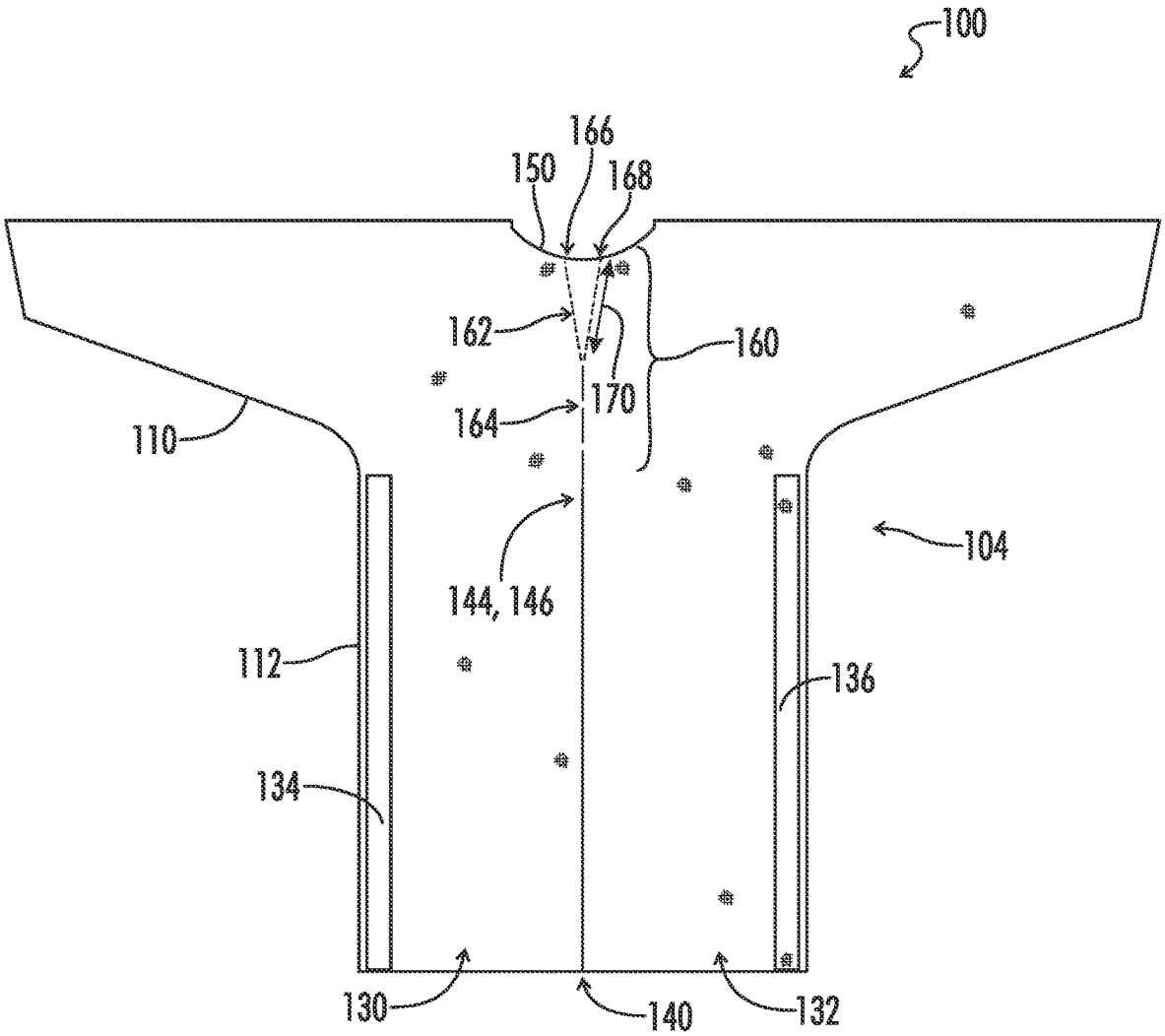
FIG. 4 is a rear elevational view of an embodiment the medical gown of FIG. 1 in accordance with the present disclosure.

As shown in FIGS. 2-4, the bottom portion 112 of the medical gown 100 may include a left flap 130 and a right flap 132. The medical gown 100 may further include a left tie 134 and a right tie 136 coupled to the rear side 104 of the medical gown 100. As shown in FIGS. 2-3, the left and right flaps 130, 132 may overlap along the rear side 104 of the medical gown 100 defining a slit 140 in the rear side 104 of the medical gown 100. The slit 140 may also be referred to herein as a flap opening 140. In certain optional embodiments, shown in FIGS. 4 and 6, the left and right flaps 130, 132 may abut along the rear side 104 of the medical gown 100 to define the slit 140 in the rear side 104 of the medical gown 100. In other optional embodiments, shown in FIGS. 5 and 7, the left and right flaps 130, 132 may be eliminated in favor of continuous material 142 along at least the bottom portion 112 of the rear side 104 of the medical gown 100.

Figure 5:
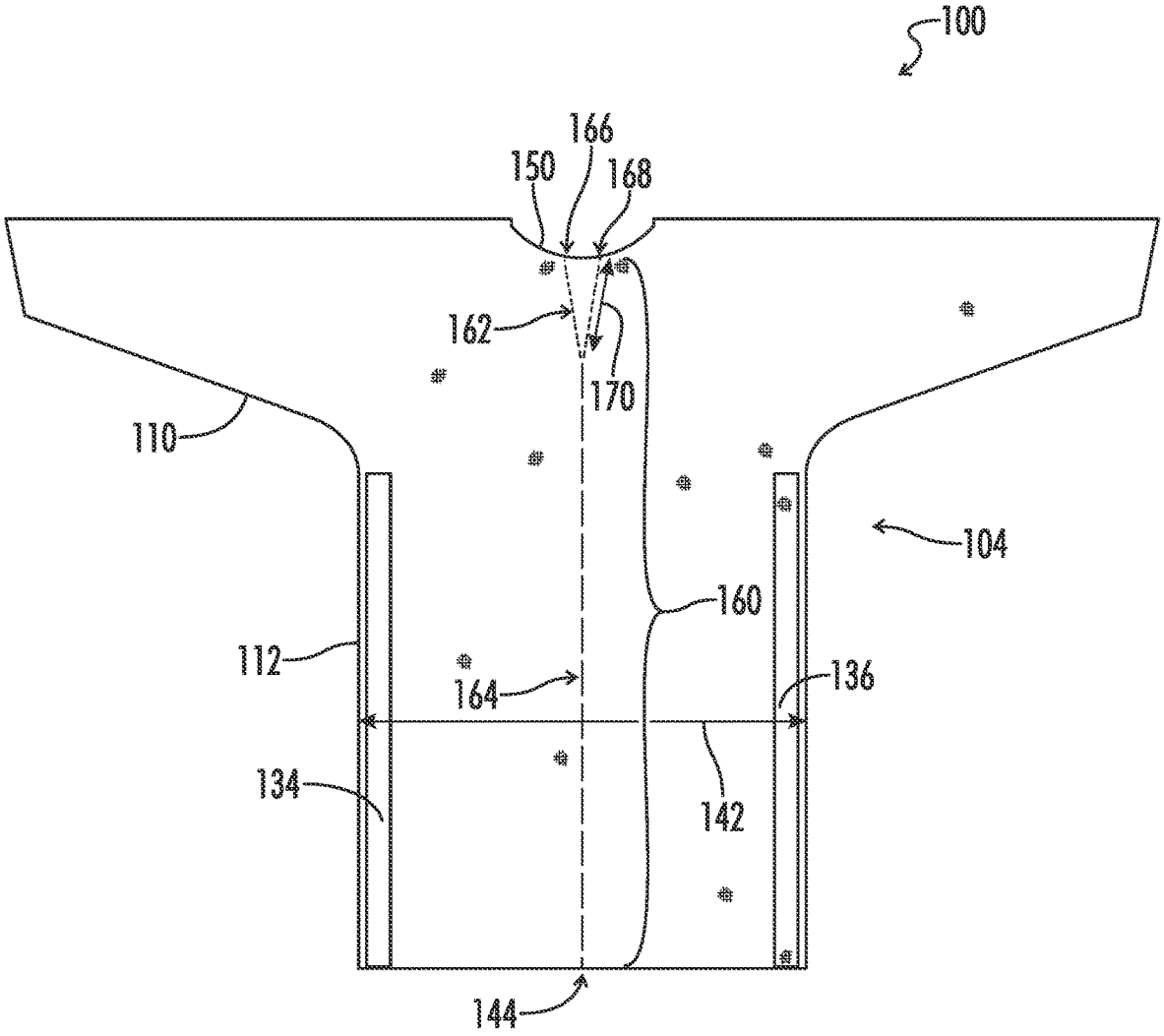
FIG. 5 is a rear elevational view of an embodiment the medical gown of FIG. 1 in accordance with the present disclosure.
Figure 6:
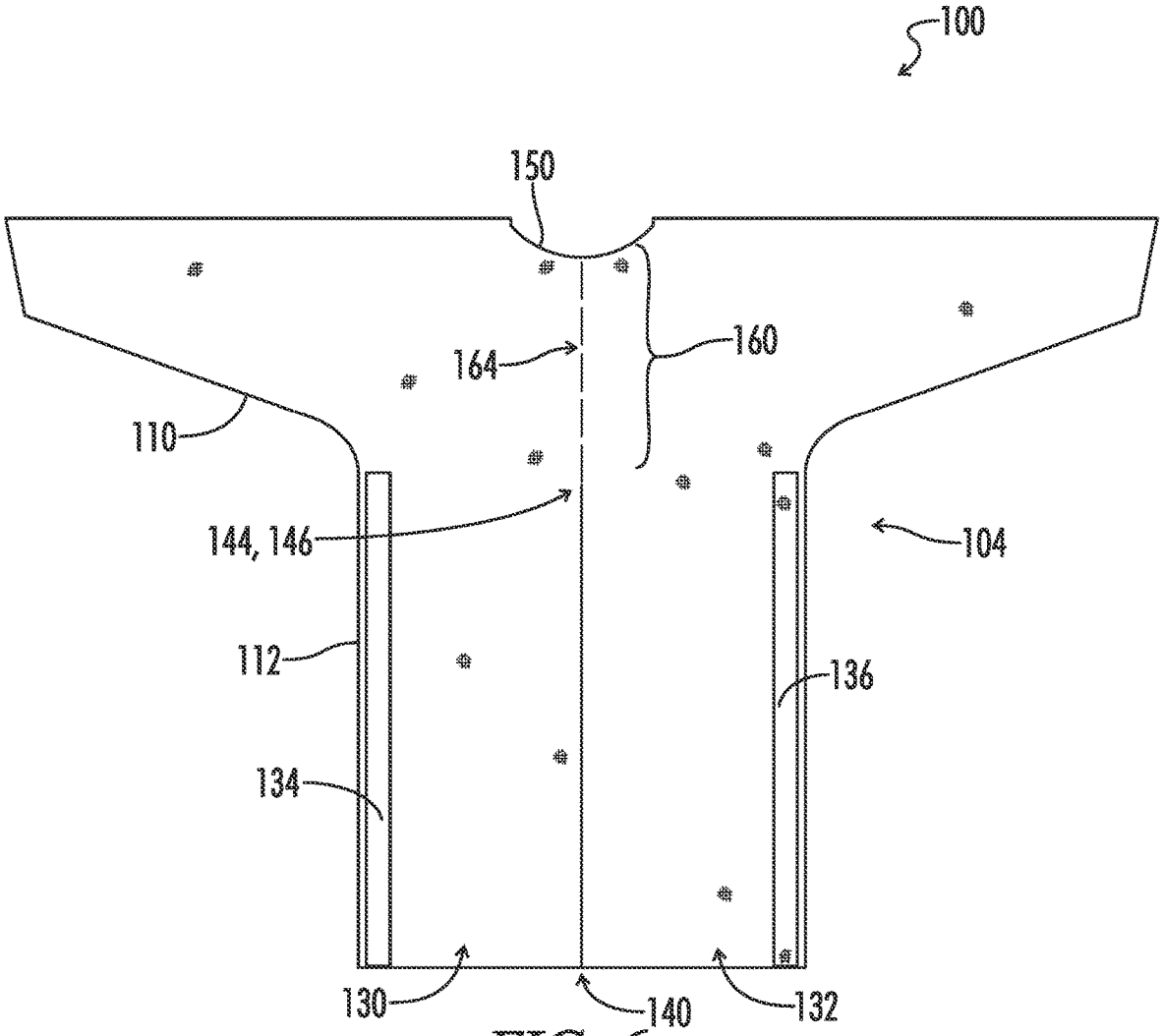
FIG. 6 is a rear elevational view of an embodiment the medical gown of FIG. 1 in accordance with the present disclosure.
Figure 7:
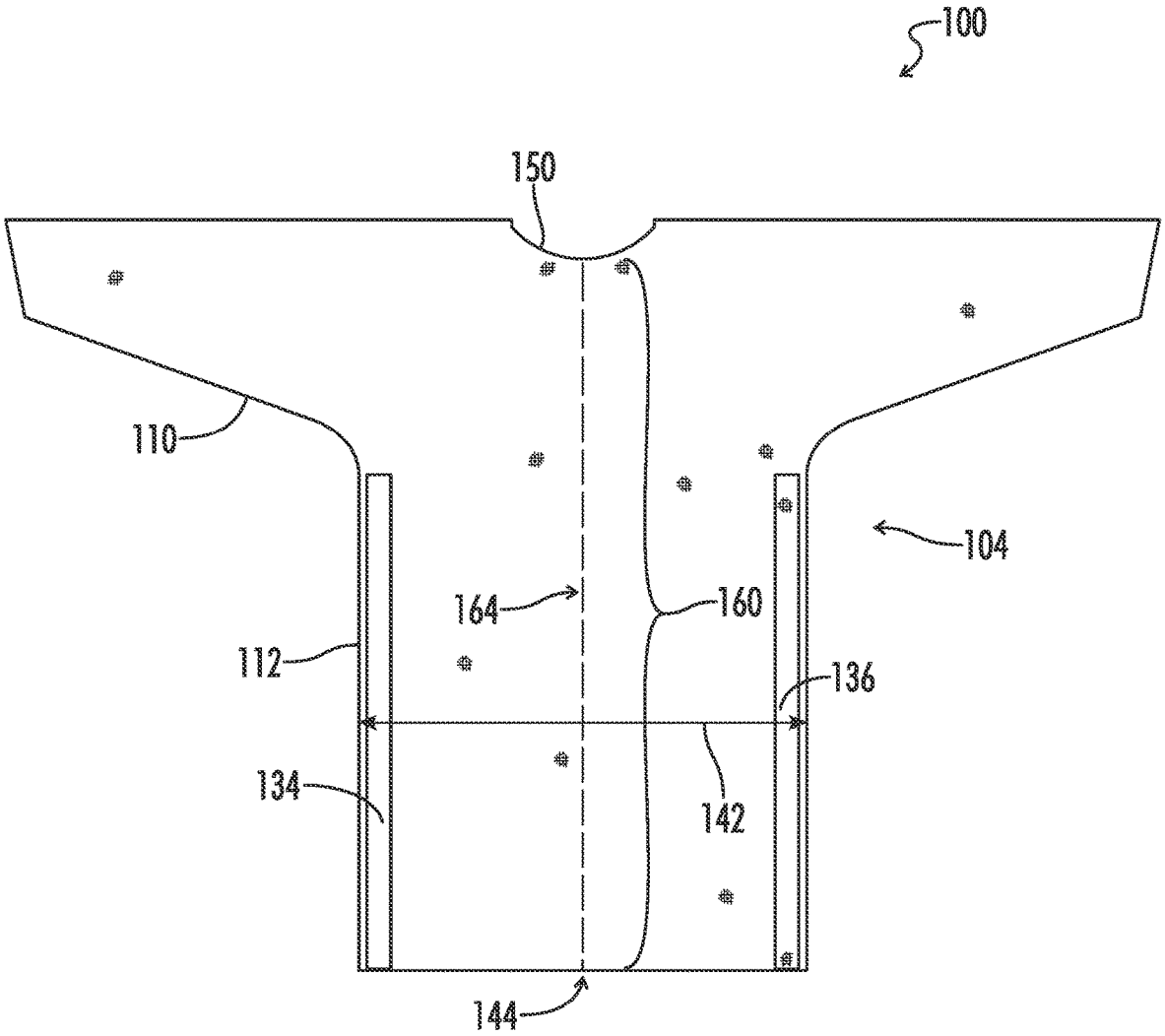
FIG. 7 is a rear elevational view of an embodiment the medical gown of FIG. 1 in accordance with the present disclosure.
Figure 8:
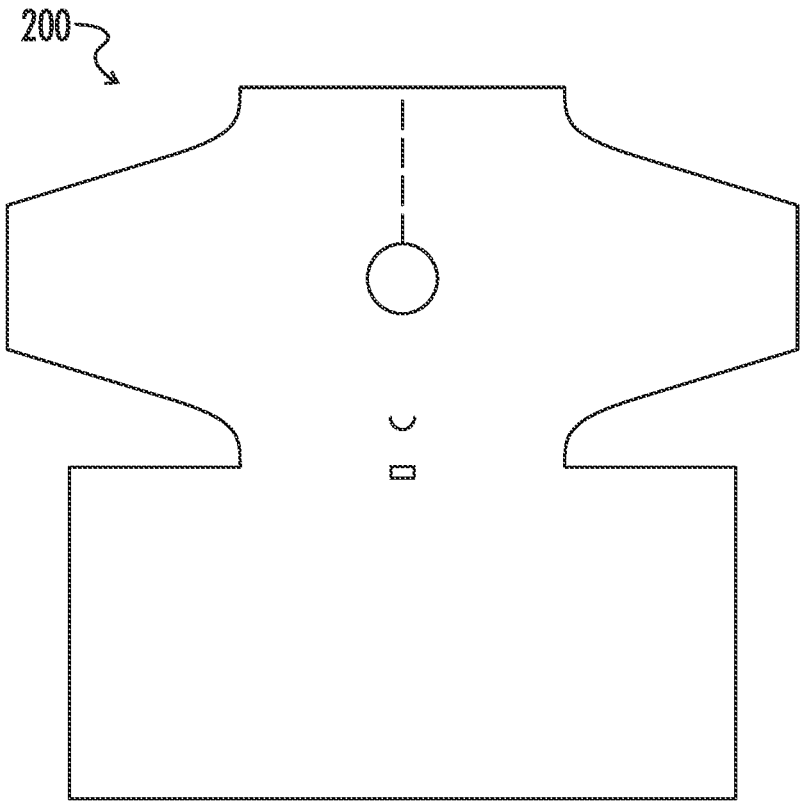
FIG. 8 is a pattern of cutting the material of the medical gown of FIG. 1 in accordance with the present disclosure.

As shown in FIGS. 2-7, the rear side 104 of the top portion 110 of the medical gown 100 may include a weakened portion 160 extending downward from a neck opening 150 of the top portion 110 towards the left and right flaps 130, 132. The weakened portion is configured to direct or guide a tear in the material as the medical gown is taken off or doffed. The weakened portion 160 may also be referred to herein as a tear guide 160 or a weakened strip of material 160. The weakened portion 160 may extend between the neck opening 150 and a nearest lower edge 144 of the rear side 104 of the medical gown 100. As shown in FIGS. 2-4, the nearest lower edge 144 may be defined by an upper end 146 of the slit 140. Alternatively, as shown in FIGS. 5-7, the nearest lower edge 144 may be defined along a bottom edge of the medical gown.

As shown in FIGS. 2-5, the weakened portion 160 may include a V-shaped portion 162 extending downward from the neck opening 150 and a straight portion 164 extending downward from the V-shaped portion 162. As shown in FIGS. 2-4, the straight portion 164 may terminate into the slit 140 of the bottom portion 112 of the medical gown 100. As shown in FIG. 5, the straight portion 164 may extend from the V-shaped portion 162 all the way down the rear side 104 of the medical gown 100. The V-shaped portion 162 may be designed to help the medical gown 100 more easily rip along the weakened portion 160 when the medical gown 100 is doffed. The V-shaped portion 162 may be coupled to the neck opening 150 at first and second locations 166, 168, separated, for example, by 2 inches, or some other amount to optimally direct ripping thereof. The V-shaped portion 162 may include a length 170 of at least 4 inches. In other optional embodiments, the length 170 may be greater than or less than 4 inches.

As shown in FIGS. 6-7, the weakened portion 160 may only include the straight portion 164 extending downward from the neck opening 150. As shown in FIG. 6, the straight portion 164 may terminate into the slit 140 of the bottom portion 112 of the medical gown 100. As shown in FIG. 7, the straight portion 164 may extend from the neck opening 150 all the way down the rear side 104 of the medical gown 100.

The weakened portion 160 of the upper portion 110 may enable the medical gown 100 to be doffed (e.g., removed) by pulling the medical gown 100 forward away from the user's body, such that the medical gown 100 rips along the weakened portion 160.

The weakened portion 160 of the top portion 110 may be formed using a ultrasonic sewing to define at least one score line, which weakens the material. The weakened portion 160 created using ultrasonic sewing may be implemented in place of traditional perforations or for medical gowns having no perforations. Alternatively, the weakened portion 160 may be created using heat welding, traditional ultrasonic welding, radio-frequency (RF) welding, or the like. Each of the welding processes may advantageously preserves the integrity of the material for preventing the transmission of germs and microbes. Ultrasonic sewing or welding is an industrial process whereby high-frequency ultrasonic acoustic vibrations are locally applied to workpieces being held together under pressure to create a solid-state weld. Alternatively, the heat weld process is performed by applying heat at a specific temperature and at specific locations, for example, along at least the top portion 110 to create the weakened portion 160 (e.g., or any portion that is comprised of continuous material 142 along the rear side 104 of the medical gown 100). RF welding, also known as dielectric welding and high-frequency welding, is a welding process that utilizes high-frequency electric fields to induce heating and melting.

In certain optional embodiments, any part of the medical gown 100 may include a weakened portion 160 created using one or more of the welding processes. It should be appreciated by one of skill in the art that the shape and path of the weakened portion 160 may be altered to fit the needs of different medical gown designs such that the medical gown 100 may easily be doffed by pulling the medical gown 100 forward away from the user's body. For example, the path of the weakened portion 160 may be optimized to more easily rip upon pulling the medical gown 100 forward away from the user's body.

Figure 9:
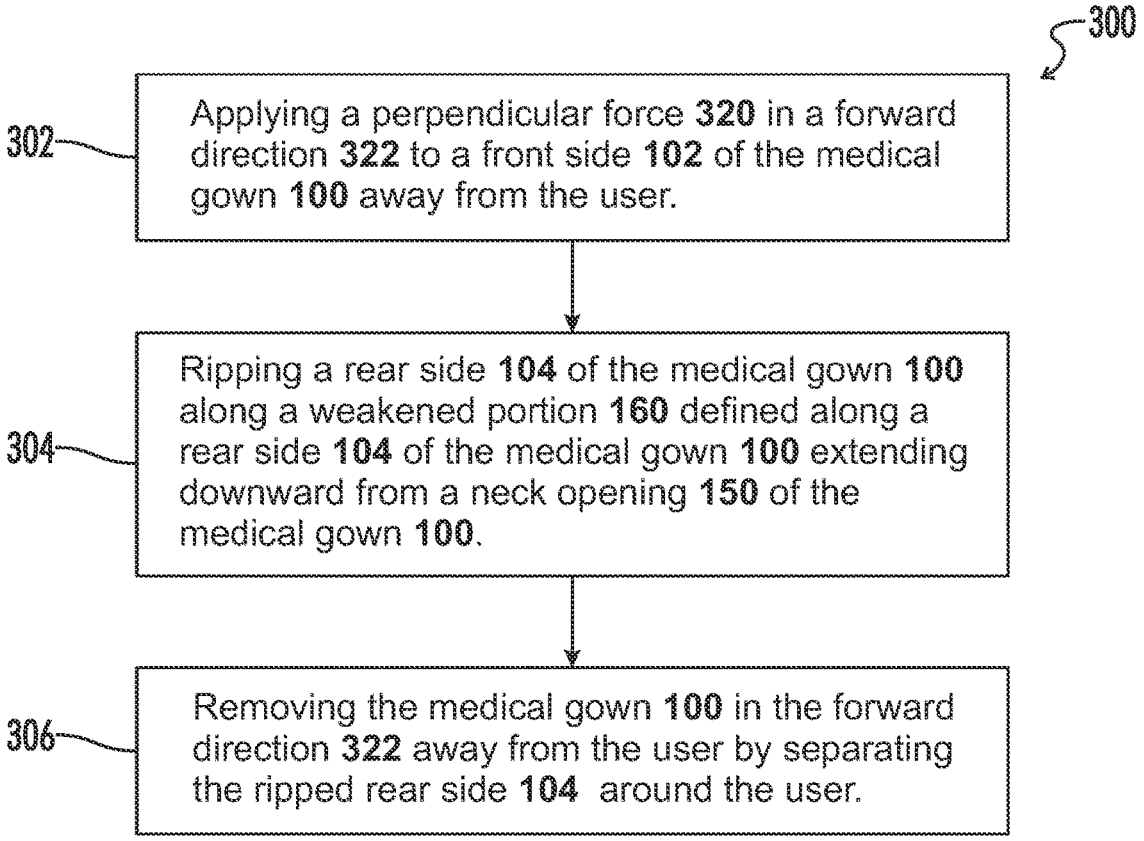
FIG. 9 is a flow chart of a method of doffing the medical gown of FIG. 1 in accordance with the present disclosure.

Referring to FIG. 9, a flow chart of a method 300 of doffing the medical gown 100 which surrounds at least a portion of a user is illustrated. The method 300 may comprise applying 302 a perpendicular force 320 in a forward direction 322 to a front side 102 of the medical gown 100 away from the user. The method 300 may further comprise ripping 304 a rear side 104 of the medical gown 100 along a weakened portion 160 defined along a rear side 104 of the medical gown 100 extending downward from a neck opening 150 of the medical gown 100. The weakened portion 160 may be created by heat welding a portion of the rear side 104 of the medical gown 100. The rip may occur along or proximate to the weakened portion 160.

The method 300 may further comprise removing 306 the medical gown 100 in the forward direction 322 away from the user by separating the ripped rear side 104 around the user.

Figure 10:
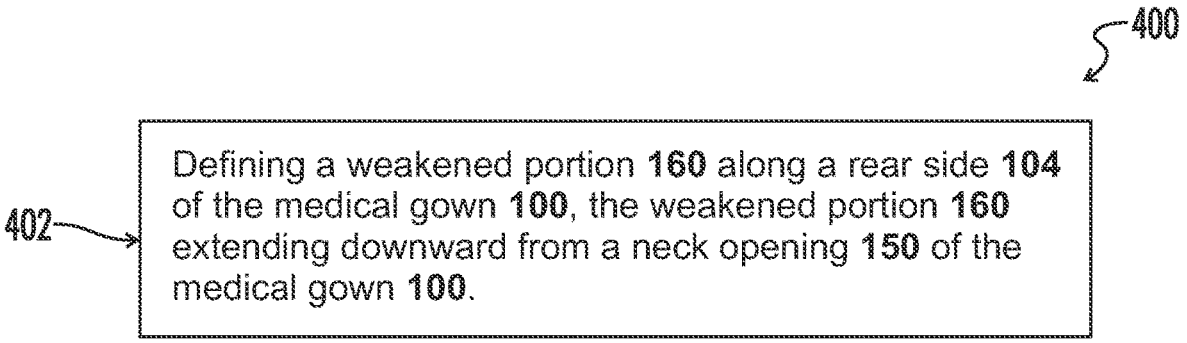
FIG. 10 is a flow chart of a method of creating the medical gown of FIG. 1 configured for controlled doffing away from a user in accordance with the present disclosure.

Referring to FIG. 10, a flow chart of a method 400 of creating a medical gown 100 configured for controlled doffing away from a user. The method 400 may comprise defining 402 a weakened portion 160 along a rear side 104 of the medical gown 100, the weakened portion 160 extending downward from a neck opening 150 of the medical gown 100. The weakened portion 160 may extend from the neck opening 150 to the nearest lower edge 144 defined along a portion of the rear side 104 of the medical gown 100.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful "Medical Gown with Tear Guide Feature", it is not intended that such references be construed as limitations upon the scope of this disclosure except as set forth in the following claims.

What is claimed is:

1. A medical gown comprising:

a neck opening; and a tear guide formed by a weakened strip of material, the tear guide extending downwardly from the neck opening along a rear side of the medical gown, and the tear guide having a V-shaped portion and a straight portion, the V-shaped portion including a pair of score lines extending downward from the neck opening and converging at a point, the straight portion including a score line extending downward from the point of the V-shaped portion, wherein each of the V-shaped portion and the straight portion are configured to direct a tear in the material as the medical gown is doffed from a user wearing the medical gown.

2. The medical gown of claim 1, wherein:

the V-shaped portion of the tear guide extends from the neck opening and the straight portion extends to a nearest lower edge of the rear side of the medical gown.

3. The medical gown of claim 2, wherein:

the nearest lower edge comprises an upper end of a flap opening of the rear side of the medical gown, the flap opening defined between first and second flaps of the rear side of the medical gown.

4. The medical gown of claim 1, wherein:

the tear guide comprises a heat weld defined in the rear side of the medical gown.

5. The medical gown of claim 3:

the straight portion of the tear guide terminates into the upper end of the flap opening.

6. The medical gown of claim 1, wherein:

the V-shaped portion is coupled to the neck opening at first and second locations separated by 2 inches.

7. The medical gown of claim 1, wherein:

the V-shaped portion includes a length of at least 4 inches extending downward from the neck opening.

8. A method of doffing a medical gown configured to surround at least a portion of a user, the method comprising:

applying a perpendicular force in a forward direction to a front portion of the medical gown away from the user; and ripping a rear portion of the medical gown along a weakened strip of material defined along a rear surface of the medical gown portion, the weakened strip having a V-shaped portion and a straight portion, the V-shaped portion including a pair of score lines extending downward from a neck opening of the medical gown and converging at a point, the straight portion including a score line extending downward from the point of the V-shaped portion.

9. The method of claim 8, wherein:

the V-shaped portion and the straight portion of the weakened strip of material is created by heat welding a portion of a material of the medical gown.

10. The method of claim 8, wherein:

The ripped rear portion of the medical gown occurs along or proximate to the V-shaped portion and the straight portion of the weakened strip of material.

11. The method of claim 8, wherein:

removing the medical gown in the forward direction away from the user by separating the ripped rear portion around the user.

12. A method of creating a medical gown configured for controlled doffing away from a user, the method comprising:

defining a weakened portion along a rear surface of the medical gown, the weakened portion having a V-shaped portion and a straight portion, the V-shaped portion including a pair of score lines extending downward from a neck opening of the medical gown and converging at a point, the straight portion including a score line extending downward from the point of the V-shaped portion; and directing a tear in the weakened portion along the V-shaped portion and the straight portion so as to remove the medical gown from the user.

13. The method of claim 12, wherein:

the V-shaped portion of the weakened portion extends from the neck opening to the straight portion of the weakened portion, the straight portion of the weakened portion extending to a nearest lower edge defined along a portion of the rear surface of the medical gown.

14. The method of claim 13, wherein:

the nearest lower edge of the medical gown comprises an upper end of a flap opening of the rear surface of the medical gown.

15. The method of claim 14, wherein:

the straight portion of the weakened portion terminates into the flap opening of the rear surface.

* * * * *